US011446798B2

(12) United States Patent
Lin

(10) Patent No.: US 11,446,798 B2
(45) Date of Patent: Sep. 20, 2022

(54) TORQUE TOOL

(71) Applicant: Yu-Ching Lin, Taichung (TW)

(72) Inventor: Yu-Ching Lin, Taichung (TW)

( * ) Notice: Subject to any disclaimer, the term of this patent is extended or adjusted under 35 U.S.C. 154(b) by 76 days.

(21) Appl. No.: 17/096,526

(22) Filed: Nov. 12, 2020

(65) Prior Publication Data

US 2022/0143792 A1 May 12, 2022

(51) Int. Cl.
*B25B 23/14* (2006.01)
*B25B 13/06* (2006.01)

(52) U.S. Cl.
CPC ..... *B25B 23/141* (2013.01); *B25B 13/065* (2013.01)

(58) Field of Classification Search
CPC .. B25B 23/1427; B25B 23/141; B25B 13/065
USPC ..... 81/472, 473, 474, 475, 476, 483
See application file for complete search history.

(56) References Cited

U.S. PATENT DOCUMENTS 6,070,506 A * 6/2000 Becker ..... B25B 23/1425 81/479
9,421,675 B2 * 8/2016 Yu ..... B25B 23/141
2006/0236827 A1 * 10/2006 Chiu ..... B25B 13/483 81/475
2017/0232594 A1 * 8/2017 Muniswamappa ..... B25B 23/1427 81/477

FOREIGN PATENT DOCUMENTS

DE 202007017694 U1 * 4/2008 ..... B25B 23/141
KR 20080023432 A * 3/2008
WO WO-2019219505 A1 * 11/2019 ..... B25B 13/466

* cited by examiner

*Primary Examiner* — Anne M Kozak
*Assistant Examiner* — Tyler James McFarland
(74) *Attorney, Agent, or Firm* — Muncy, Geissler, Olds & Lowe, P.C.

(57) ABSTRACT

A torque tool is provided, including: a barrel; a first member disposed to the barrel, including at least one first engaging portion; a second member disposed in the barrel, including at least one second engaging portion, the at least one second engaging portion and the at least one first engaging portion being disengageably engaged with each other; an elastic mechanism, disposed inside the barrel and including elastic arms, the second member being configured to abut and radially deform the elastic arms; wherein when there is a torsional three greater than a preset torque value between the at least one second engaging portion and the at least one first engaging portion, the second member urges and radially defines the plurality of elastic arms so that the at least one second engaging portion and the at least one first engaging portion are relatively slipable and disengageable.

7 Claims, 5 Drawing Sheets

TORQUE TOOL

BACKGROUND OF THE INVENTION

Field of the Invention

The present invention relates to a torque tool.

Description of the Prior Art

Generally, socket tools are often used for disassembling and assembling workpieces such as screws, nuts, etc. However, the conventional socket tool cannot apply constant torque to a workpiece during operation, and thus it is difficult for users to control the torque applied to the workpiece, thus causing inconvenience in disassembly and assembly, and thus damaging the workpiece easily.

Therefore, torque tools are provided, accordingly. A main body of the conventional torque tool is provided with a driving head, and the main body of the torque tool includes a torque-adjusting mechanism for controlling applying torque within a set range so as to avoid damage to the workpiece. However, the torque-adjusting mechanism of the conventional torque tools can only provide a limited range of torque control, which narrows the applications for assembling/disassembling.

The present invention is, therefore, arisen to obviate or at least mitigate the above-mentioned disadvantages.

SUMMARY OF THE INVENTION

The main object of the present invention is to provide a torque tool which can avoid damage to driven piece or workpiece.

To achieve the above and other objects, a torque tool, including: a barrel; a first member, disposed at one end of the barrel, including at least one first engaging portion; a second member, disposed in the barrel, including at least one second engaging portion, on a rotation path of the second member, the at least one second engaging portion and the at least one first engaging portion being disengageably engaged with each other; an elastic mechanism, connected to and inside the barrel and including a plurality of elastic arms, the second member being configured to abut the plurality of elastic arms and radially deform the plurality of elastic arms; wherein when there is a torsional force greater than a preset torque value between the at least one second engaging portion and the at least one first engaging portion, the second member urges and radially deforms the plurality of elastic arms so that the at least one second engaging portion and the at least one first engaging portion are relatively slipable and disengageable.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
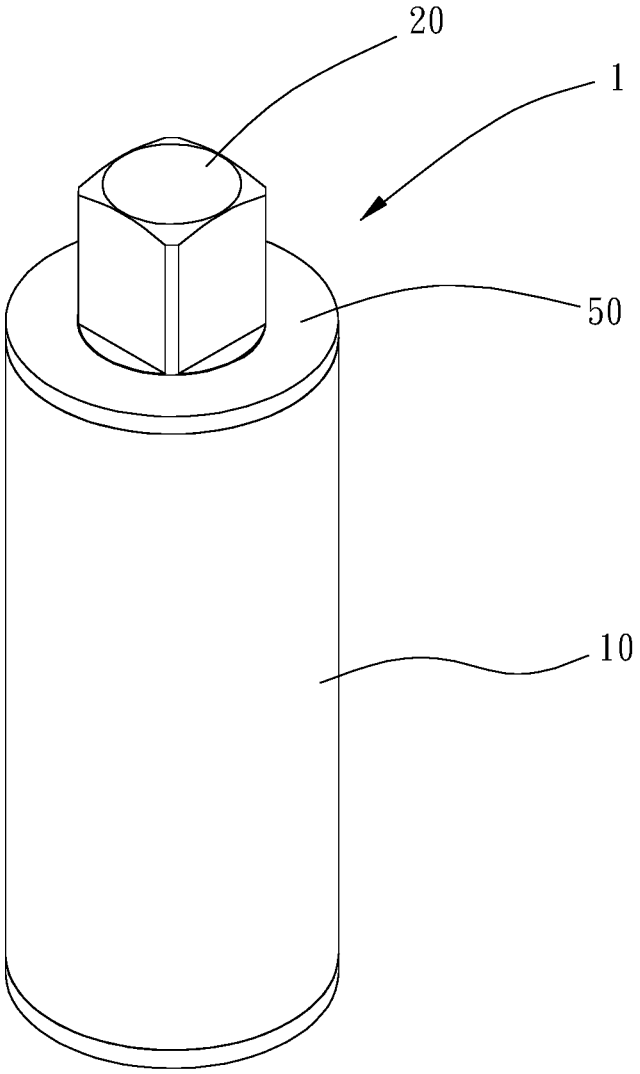
FIG. 1 is a stereogram of a preferable embodiment of the present invention.
Figure 2:
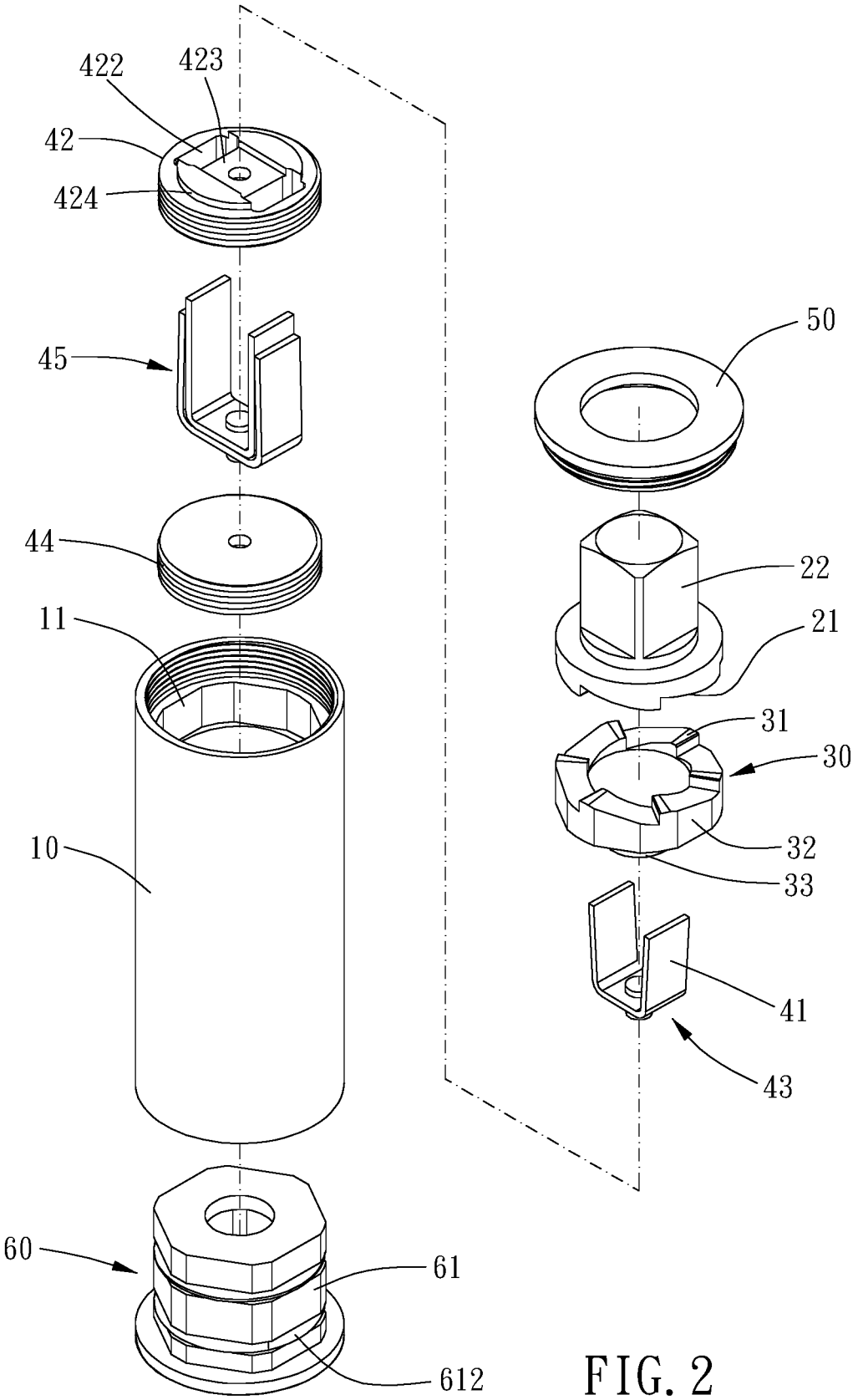
FIG. 2 is a breakdown drawing of a preferable embodiment of the present invention.
Figure 3:
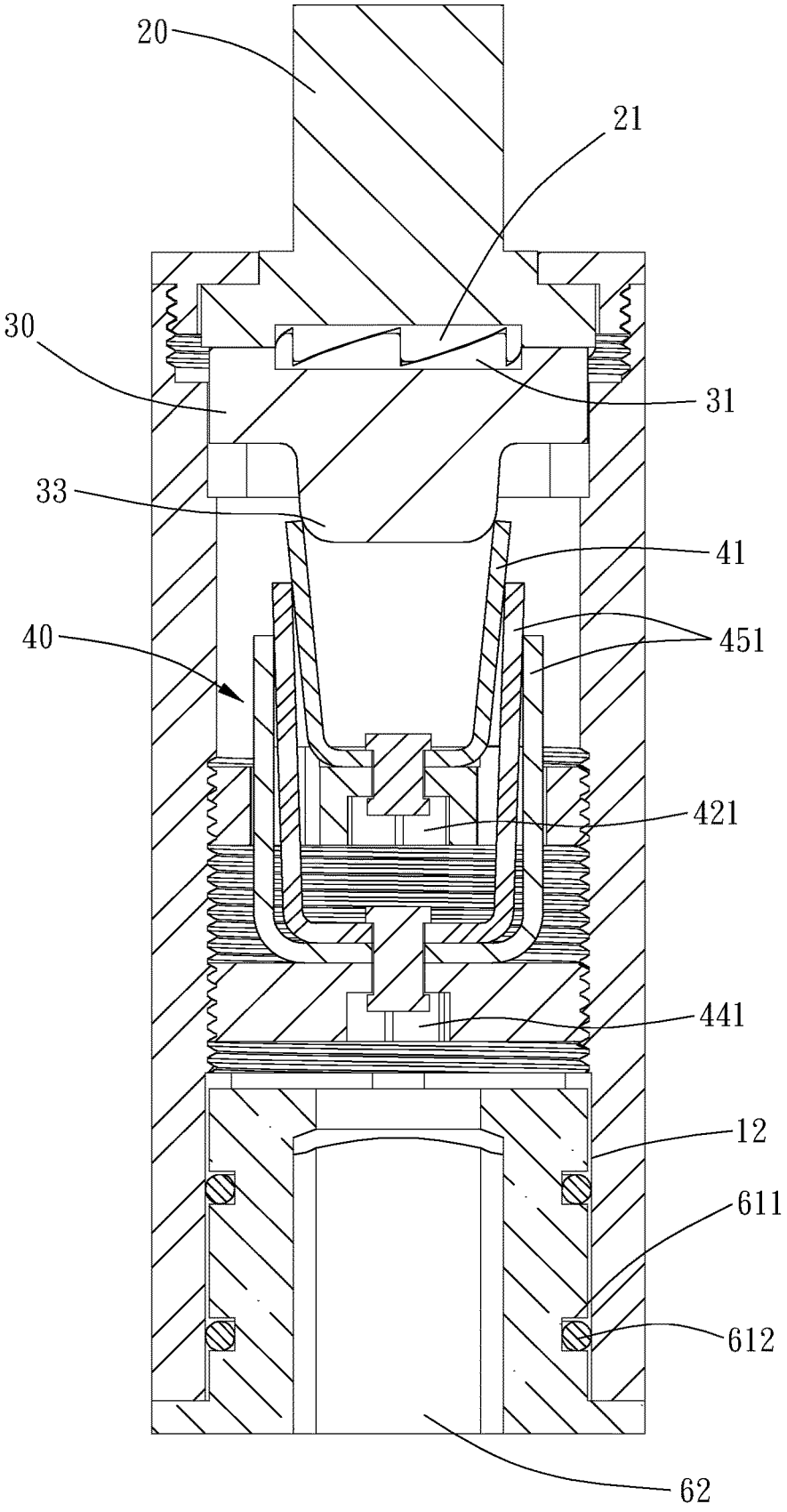
FIGS. 3 and 4 are cross-sectional views showing a torque tool in an engaged state according a preferable embodiment of the present invention.
Figure 4:
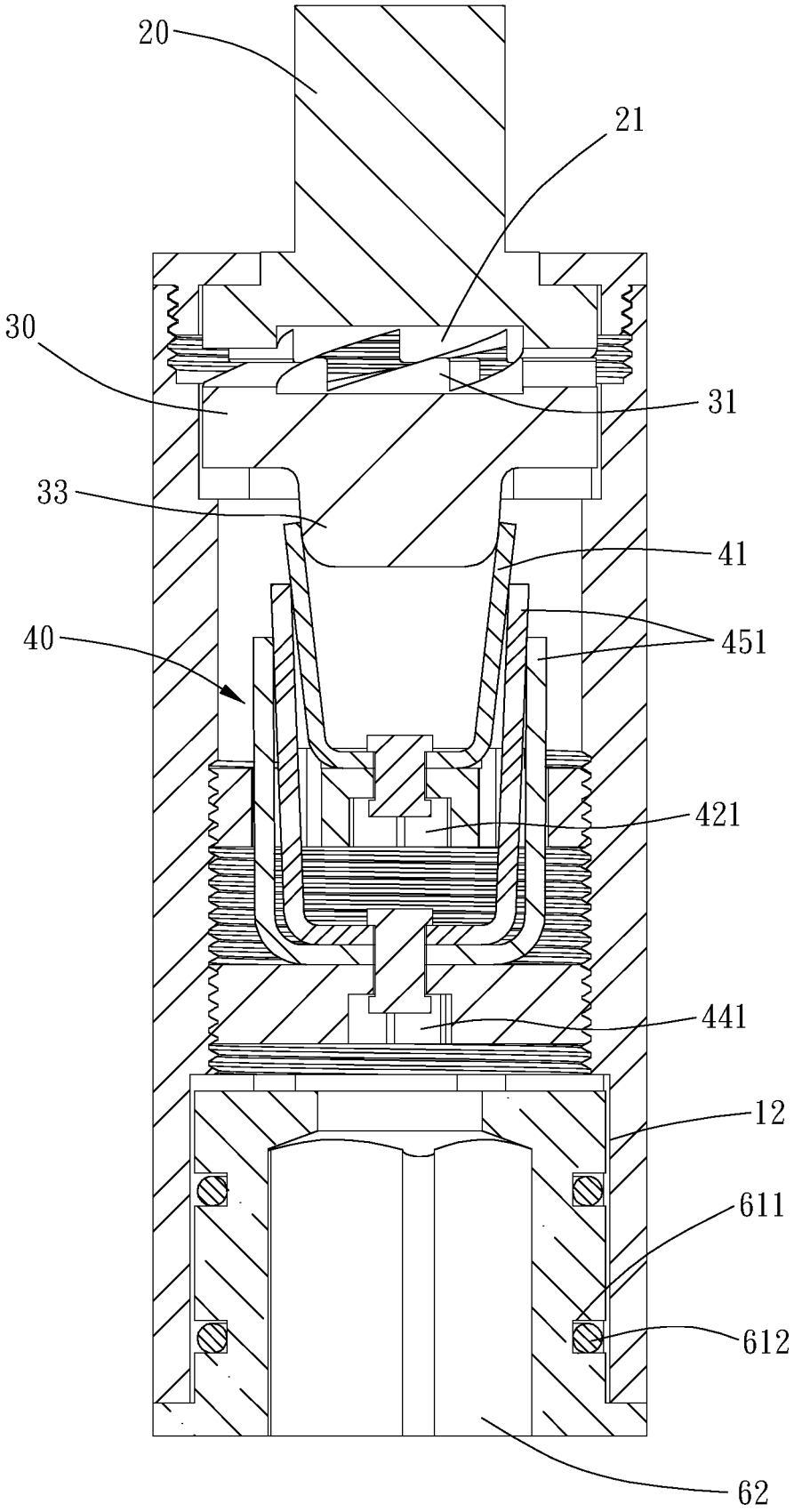
Figure 5:
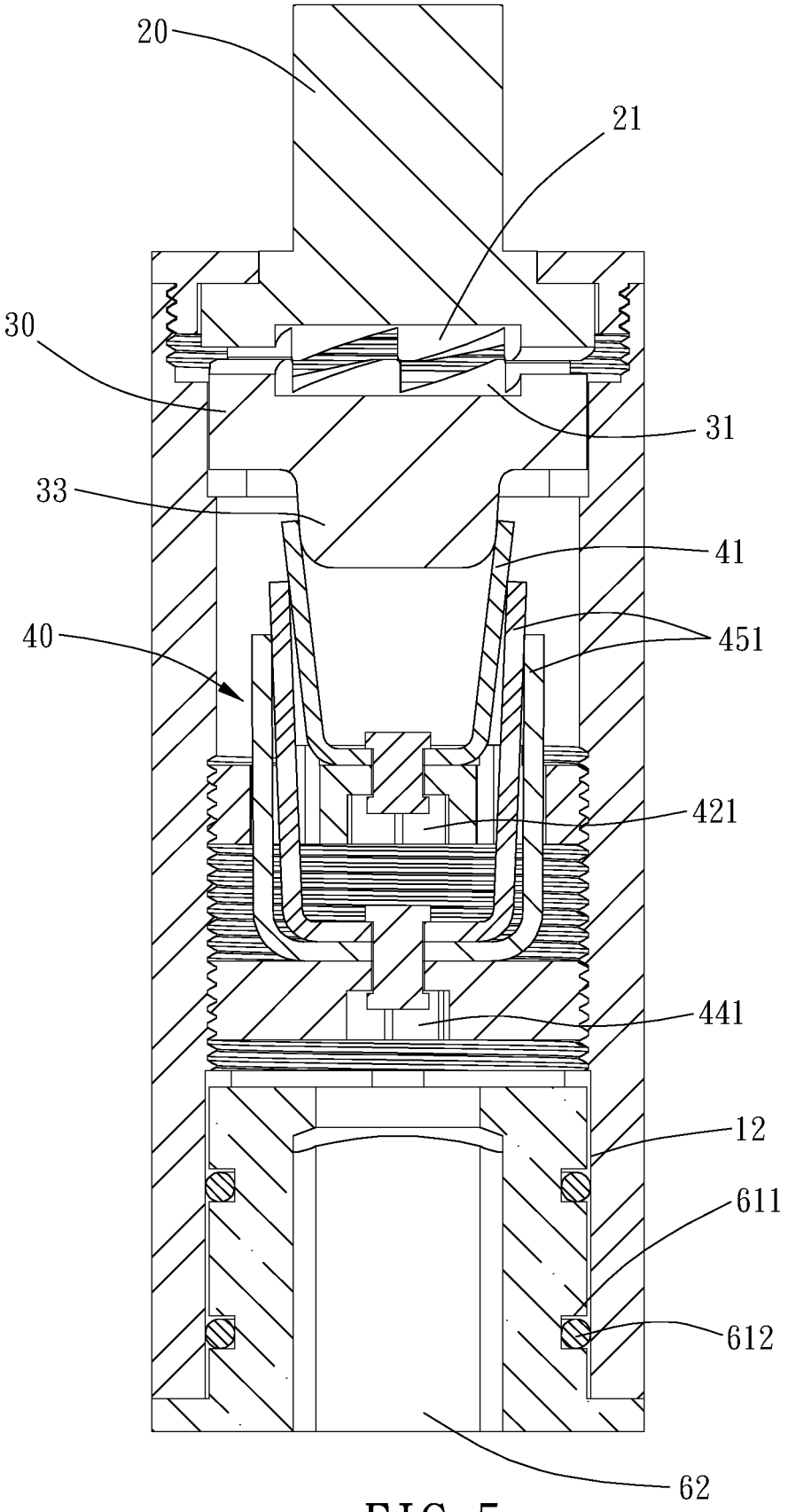
FIG. 5 is a cross-sectional view showing the torque tool in a disengaged state according a preferable embodiment of the present invention.

Please refer to FIGS. 1 to 5 for a preferable embodiment of the present invention. A torque tool 1 of the present invention includes a barrel 10, a first member 20, a second member 30 and an elastic mechanism 40.

The first member 20 is disposed the barrel 10 at one end of and includes at least one first engaging portion 21. The second member 30 is disposed in the barrel 10, the second member 30 includes at least one second engaging portion 31, on a rotation path of the second member 30, the at least one second engaging portion 31 and the at least one first engaging portion 21 are disengageably engaged with each other (FIG. 3 (completely engaged) and FIG. 4 (partially engaged)), for transmitting torsional force. The elastic mechanism 40 is connected to and inside the barrel 10 and includes a plurality of elastic arm 41, the second member 30 configured to abut the plurality of elastic arms 41 and radially deform the plurality of elastic arms 41. When there is a torsional force greater than a preset torque value between the at least one second engaging portion 31 and the at least one first engaging portion 21, the second member 30 urges and radially deforms the plurality of elastic arms 41 so that the at least one second engaging portion 31 and the at least one first engaging portion 21 are relatively slipable and disengageable (FIG. 5), which can avoid damage to driven piece or workpiece. The at least one first engaging portion 21 and the at least one second engaging portion 31 may be configured to be cooperative inclined faces, arcuate faces or the like.

Preferably, the first member 20 is replaceably assembled to the barrel 10 so that the first member can be replaced to have a suitable size, type or function according to various requirements. Specifically, the first member 20 is disposed through an annular lid 50 screwed to the barrel 10, and the first member 20 is rotatable relative to the barrel 10. An inner wall of the barrel 10 includes a first non-circular section 11, and the second member 30 includes a non-circular circumferential surface 32 and unrotatably assembled with the first non-circular section 11, and thus the second member 30 and the barrel 10 are movable with each other. The second member 30 further includes a conical portion 33, and the conical portion 33 is tapered toward the elastic mechanism 40 and abutted between the plurality of elastic arms 41. The conical portion 33 is advantageous to stable and smooth abutment against the plurality of elastic arms 41, which can provide good control of disengagement of the at least one second engaging portion 31 and the at least one first engaging portion 21 and precise outputting torque. However, the conical portion 33 may be replaced by other configuration(s) such as a structure including a plurality of inclined slots, inclined faces, arcuate faces or the like.

Preferably, the elastic mechanism 40 is assembled to the barrel 10 the barrel 10 and axially adjustable relative to the barrel 10. The elastic mechanism 40 includes a first base member 42 and at least one first elastic member 43 disposed on the first base member 42. The first base member 42 is assembled to the an inner wall of the barrel 10, wherein the first base member 42 may be assembled to the inner wall of the barrel 10 by screwing or any other proper way. The elastic mechanism 40 further includes a second base member 44 and at least one second elastic member 45 disposed on the second base member 44. The second base member 44 is assembled (by screwing or any other proper way) to the inner wall of the barrel 10 and axially adjustable relative to the barrel 10. The first base member 42 is located between the second member 30 and the second base member 44, and the at least one second elastic member 45 is abutted against an outer side of the plurality of elastic arms 41. Another end of the barrel 10 includes a socket portion 60, the first base member 42 includes a driving hole 421 extending toward the socket portion 60 and configured for connection of a driving tool, which is easy to adjust the first base member 42 so as to adjust abutting state of the plurality of elastic arms 41 and the second member 30; the second base member 44 includes a driving hole 441 extending toward the socket portion 60 and configured for connection of a driving tool, the at least one second elastic member 45 and the second base member 44 are rotatably pinned with each other, which is easy to adjust the second base member 44 so as to change abutting point and force of the at least one second elastic member 45 on the plurality of elastic arms 41, for adjusting the preset torque value of the torque tool 1.

In this embodiment, the at least one first elastic member 43 includes the plurality of elastic arms 41, the first base member 42 further includes a plurality of through holes 422, and the at least one second elastic member 45 is disposed through the plurality of through holes 422. The at least one second elastic member 45 includes a plurality of plate-form springs 451, and distal ends of the plurality of plate-form springs 451 and a distal end of the at least one first elastic member 43 are axially offset from one another. Through different abutting relationship of the at least one first elastic member 43 and the plurality of plate-form springs 451, a large range of operation torque can be provided. The first base member 42 further includes a recession 423, and the at least one first elastic member 43 is pinned with the first base member 42, the at least one first elastic member 43 is partially and limitedly engaged within the recession 423. Preferably, the first base member 42 further includes a protrusion 424, and the recession 423 extends radially through the protrusion 424, wherein the protrusion 424 enhances the structural strength.

The socket portion 60 has a non-circular circumferential surface 61, the inner wall of the barrel 10 further includes a second non-circular section 12, and the socket portion 60 is rotatably assembled with the second non-circular section 12. The non-circular circumferential surface 61 of the socket portion 60 includes at least one annular groove 611 and at least one ring retainer 612 engaged within the at least one annular groove 611 (such as C-shaped spring), and the at least one ring retainer 612 is radially abutted against the second non-circular section 12. It is noted that the second non-circular section 12 may be provided with at least one recess so that the at least one ring retainer 612 can be engaged within the at least one recess and the at least one annular groove 611, thus being easy to assemble the socket portion 60 to the barrel 10 or disassemble the socket portion 60 from the barrel 10 for change another socket portion of different type or size. It is noted that the socket portion may be assembled to the barrel 10 by screwing or other ways, or may be fixedly connected with the barrel.

In this embodiment, the first member 20 is provided at an end thereof with a square projection 22 configured for assembling of a socket tool, for example; the socket portion 60 is provided at air end thereof with a square hole 62 configured for assembling of an outputting shaft of a power tool, for example. However, the first member 20 and/or the socket portion 60 may be provided with different assembling structure or connector for connection of one of various tools such as socket tools, drivers, or manual or power tools.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque tool, including:

a barrel;

a first member, disposed at one end of the barrel, including at least one first engaging portion;

a second member, disposed in the barrel, including at least one second engaging portion, on a rotation path of the second member, the at least one second engaging portion and the at least one first engaging portion being disengageably engaged with each other;

an elastic mechanism, connected to and inside the barrel and including a plurality of elastic arms, the second member being configured to abut the plurality of elastic arms and radially deform the plurality of elastic arms;

wherein when there is a torsional force greater than a preset torque value between the at least one second engaging portion and the at least one first engaging portion, the second member urges and radially deforms the plurality of elastic arms so that the at least one second engaging portion and the at least one first engaging portion are relatively slipable and disengageable;

wherein the elastic mechanism includes a first base member and at least one first elastic member disposed on the first base member, the first base member is assembled to an inner wall of the barrel, and the at least one first elastic member includes the plurality of elastic arms;

wherein the elastic mechanism further includes a second base member and at least one second elastic member disposed on the second base member, the second base member is assembled to the inner wall and axially adjustable relative to the barrel, the first base member is located between the second member and the second base member, and the at least one second elastic member is abutted against an outer side of the plurality of elastic arms; wherein the first base member includes a plurality of through holes, and the at least one second elastic member is disposed through the plurality of through holes.

2. The torque tool of claim 1, wherein the first member is replaceably assembled to the barrel.

3. The torque tool of claim 1, wherein the elastic mechanism is assembled to the barrel and axially adjustable relative to the barrel.

4. The torque tool of claim 1, wherein the at least one second elastic member includes a plurality of plate-form springs, and distal ends of the plurality of plate-form springs and a distal end of the at least one first elastic member are axially offset from one another.

5. The torque tool of claim 1, wherein the first base member includes a recession, and the at least one first elastic member is partially and limitedly engaged within the recession.

6. The torque tool of claim 5, wherein the first base member further includes a protrusion, and the recession extends radially through the protrusion.

7. The torque tool of claim 1, wherein the first member is disposed through an annular lid screwed to the barrel, the first member is rotatable relative to the barrel; an inner wall of the barrel includes a first non-circular section, the second member includes a non-circular circumferential surface and unrotatably assembled with the first non-circular section; the first base member is screwed to the inner wall of the barrel; the at least one first elastic member is pinned to the first base member; the second member further includes a conical portion, the conical portion is tapered toward the elastic mechanism and abutted between the plurality of elastic arms; the at least one second elastic member and the second base member are rotatably pinned with each other; the at least one second elastic member includes a plurality of plate-form springs, distal ends of the plurality of plate-form springs and a distal end of the at least one first elastic member are axially offset from one another; the first base member includes a recession, the at least one first elastic member is partially and limitedly engaged within the recession; the first base member further includes a protrusion, the recession extends radially through the protrusion; another end of the barrel includes a socket portion, the socket portion has a non-circular circumferential surface; the inner wall of the barrel further includes a second non-circular section, the socket portion is unrotatably assembled with the second non-circular section; the non-circular circumferential surface of the socket portion includes at least one annular groove and at least one ring retainer engaged within the at least one annular groove, the at least one ring retainer is radially abutted against the second non-circular section; the first base member further includes a first driving hole extending toward the socket portion, and the second base member includes a second driving hole extending toward the socket portion.

* * * * *